US009995052B1

(12) United States Patent
Lopez

(10) Patent No.: US 9,995,052 B1
(45) Date of Patent: Jun. 12, 2018

(54) IN-FLOOR POOL CLEANER COLLAR WITH VENTURI ASSEMBLY

(71) Applicant: Pool Patch LLC, Phoenix, AZ (US)

(72) Inventor: Thomas V. Lopez, Phoenix, AZ (US)

( * ) Notice: Subject to any disclaimer, the term of this patent is extended or adjusted under 35 U.S.C. 154(b) by 180 days.

(21) Appl. No.: 14/801,809

(22) Filed: Jul. 16, 2015

(51) Int. Cl.
*E04H 4/00* (2006.01)
*E04H 4/16* (2006.01)

(52) U.S. Cl.
CPC ..... *E04H 4/169* (2013.01)

(58) Field of Classification Search
USPC ..... 4/541.6, 541.1, 490; 239/204
See application file for complete search history.

(56) References Cited

U.S. PATENT DOCUMENTS 4,322,860 A 4/1982 Gould
4,466,142 A 8/1984 Gould
4,542,853 A * 9/1985 Diamond ..... A61H 33/027 239/383
6,393,629 B1 5/2002 Barnes et al.
6,601,244 B1 8/2003 Goettl
6,971,588 B1 12/2005 Tarr et al.
6,991,182 B2 * 1/2006 Chen ..... A61H 33/027 239/251
8,533,874 B1 9/2013 Goettl
2011/0225716 A1 * 9/2011 Malinasky, Jr. ..... E04H 4/169 4/496

OTHER PUBLICATIONS

A&A Manufactuing, website, http://www.aamfg.com/G4CleaningHead.php.

* cited by examiner

*Primary Examiner* — Lauren Crane
(74) *Attorney, Agent, or Firm* — Thomas W. Galvani, P.C.; Thomas W. Galvani

(57) ABSTRACT

A device is configured for use in a swimming pool structure, the swimming pool structure including a pool and a circulation system having a piping assembly and a pump for cyclically communicating water through the piping assembly. The device includes a collar configured to be coupled directly to the piping assembly. The collar includes an upstream bottom and a downstream top. The collar includes a lower inlet at the bottom of the collar for fluid communication with the piping assembly. The collar includes an opening at the top of the collar which leads to a chamber within the collar, the chamber for holding an insert. The collar includes an upper inlet at the top of the collar for fluid communication with the pool. The collar includes a truncated open-ended cone carried downstream from the lower inlet.

14 Claims, 2 Drawing Sheets

IN-FLOOR POOL CLEANER COLLAR WITH VENTURI ASSEMBLY

FIELD OF THE INVENTION

The present invention relates generally to swimming pool cleaning systems, and more particularly to collars used for holding heads of in-floor cleaning systems.

BACKGROUND OF THE INVENTION

Some swimming pool structures are constructed with cleaning systems in which pop-up cleaner heads are installed in the floor and steps of the pool and direct jets of water across the surface of the pool to move debris collected on the surface toward a drain, where the debris is drawn into a pump and filtration system for filtering. The cleaning system typically includes the drain, an intake or upstream piping assembly coupled to the drain, and a pump for drawing water into the drain and through the upstream piping assembly to a filter for filtration. Filtered water is then communicated out through a downstream piping assembly to heads installed in the floor and steps of the pool. Conventionally, the heads are applied to collars in the surface of the pool structure. The collars are typically permanently installed in the pool structure during construction of the pool. The collars are terminals at the ends of the piping assembly, and each provides a seat to hold and secure one of the in-floor pool cleaning heads.

The cleaning system is only as effective as its ability to direct a flow of water across the pool surface, the volume of water which can be directed in that flow, and the speed and pressure of that flow. However, cleaning systems are limited in these characteristics by the capacity of the pump, the flow through a filter, the diameter of the pipes in the piping assembly, and the capacity of a head to handle, expel, and direct water, as well as the ultimate ability for a head to operate properly under different loads. For example, most heads reciprocate between raised and lowered positions to be either in an operative state or a storage state, respectively; different flow characteristics can affect the ability of the head to move properly into those raised and lowered positions.

It would be helpful to have a cleaning system which uses as few heads as possible, to cut costs and maintenance concerns. However, the fewer the heads used in a pool, the more pressure and volume of water that each individual head must expel to clean in a similar manner. Further, a valve necessary to handle such pressure and volume would be very expensive and would require a correspondingly expensive pump that could operate at high speeds. There is thus a need to improve the cleaning ability of each head without placing difficult and expensive demands on the rest of the cleaning system.

SUMMARY OF THE INVENTION

In one of several embodiments, a device is configured for use in a swimming pool structure, the swimming pool structure including a pool and a circulation system having a piping assembly and a pump for cyclically communicating water through the piping assembly. The device includes a collar configured to be coupled directly to the piping assembly. The collar includes an upstream bottom and a downstream top. The collar includes a lower inlet at the bottom of the collar for fluid communication with the piping assembly. The collar includes an opening at the top of the collar which leads to a chamber within the collar, the chamber for holding an insert. The collar includes an upper inlet at the top of the collar for fluid communication with the pool. The collar includes a truncated open-ended cone carried downstream from the lower inlet.

BRIEF DESCRIPTION OF THE DRAWINGS

Referring to the drawings.

DETAILED DESCRIPTION

Figure 2:
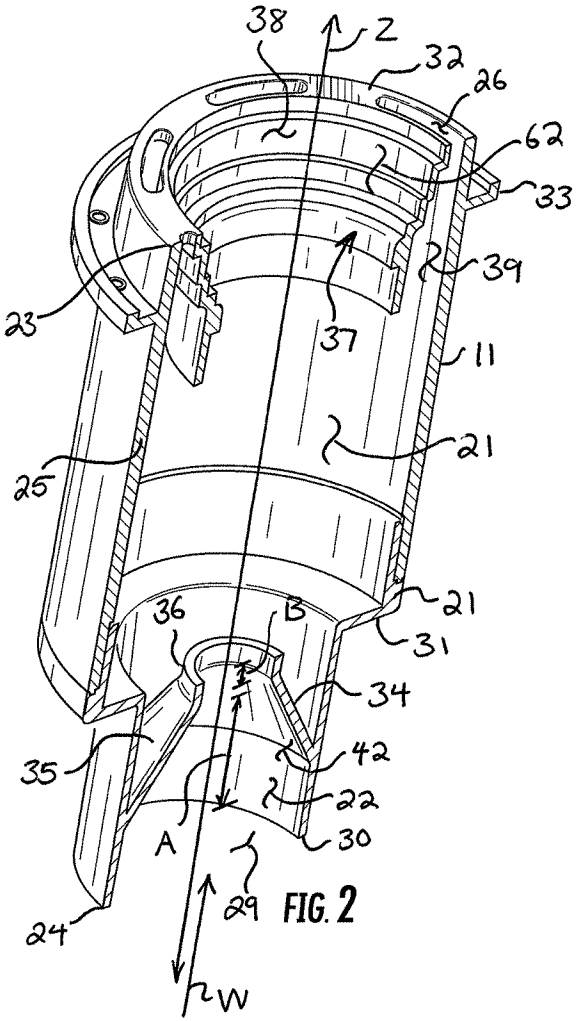
FIG. 2 is a top perspective section view of the collar of FIG. 1, taken along the line 2-2 in FIG. 1.

Reference now is made to the drawings, in which the same reference characters are used throughout the different figures to designate the same elements. FIGS. 1-4 illustrate a collar 11 for an in-floor pool cleaner head 10 having an insert 12 and a piston 13. The collar 11 is useful for increasing the velocity of water flowing through the head 10 beyond what is possible with conventional in-floor pool cleaning heads. In operation (though not shown in these drawings because the installation environment is conventional) the head 10 is coupled to a piping assembly 15, which in turn is coupled to a pump and filtration system of a swimming pool structure, so that water is communicated from the pump and filtration system through the piping assembly 15 to the head 10 to direct water across a pool surface 14. Use of the collar 11 with the head 10 produces a faster flow of water through the head 10 to be directed across the pool surface 14. This provides a more effective cleaning current of water flowing across the pool surface 14, thus allowing each head to clean more effectively. The collar 11 can receive a wide variety of heads from different manufacturers, and thus provides a platform to increase the performance of all heads which can be applied to the collar 11 without modifying those collars 11 themselves.

Figure 1:
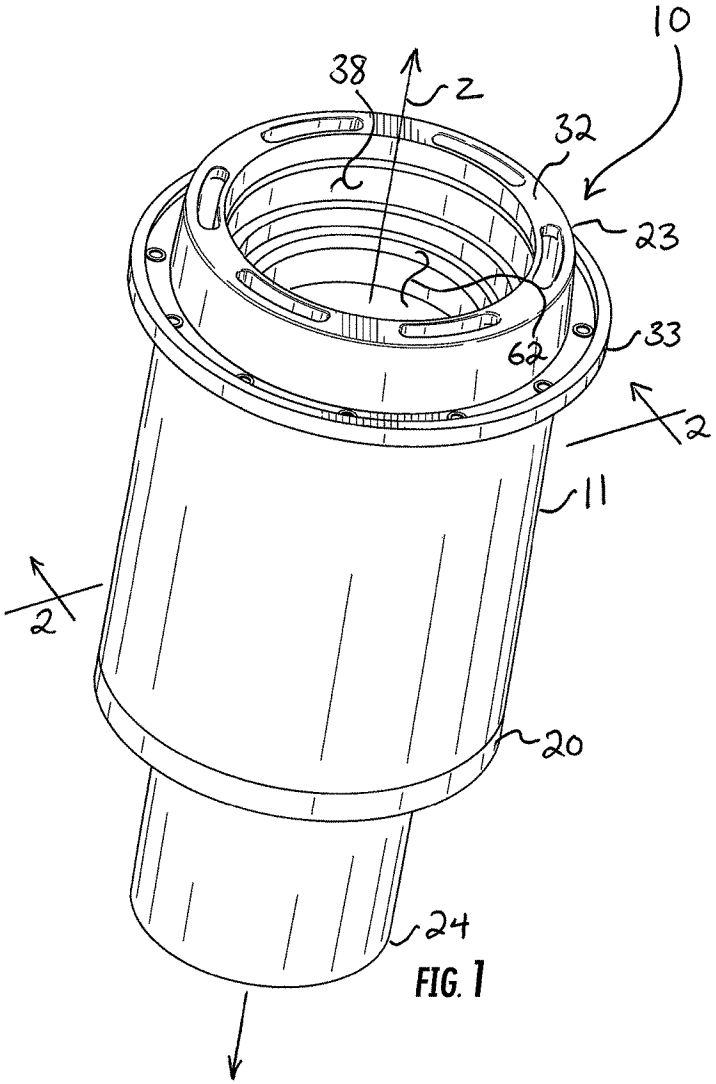
FIG. 1 is a top perspective view of a collar of an in-floor pool cleaner head, shown in isolation.
Figure 4:
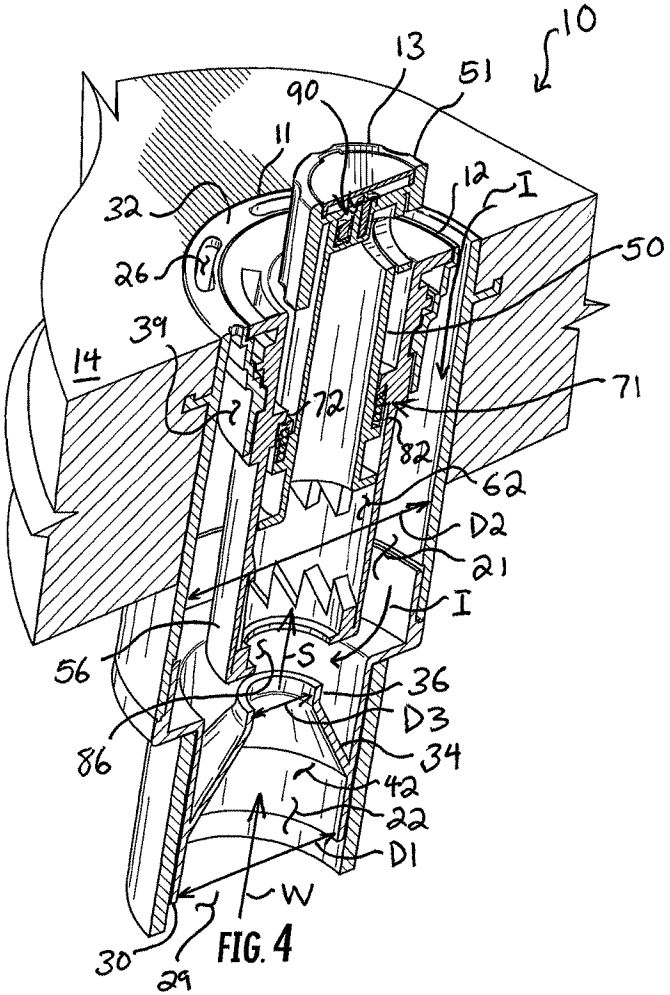
FIGS. 3 and 4 are top perspective section views of the collar of FIG. 1 installed in a pool structure and applied with the in-floor pool cleaner head, the section views each being taken along a line drawn similarly to that of line 2-2 in FIG. 1, and showing a piston carried by the head disposed in raised and lowered positions, respectively.
Figure 3:
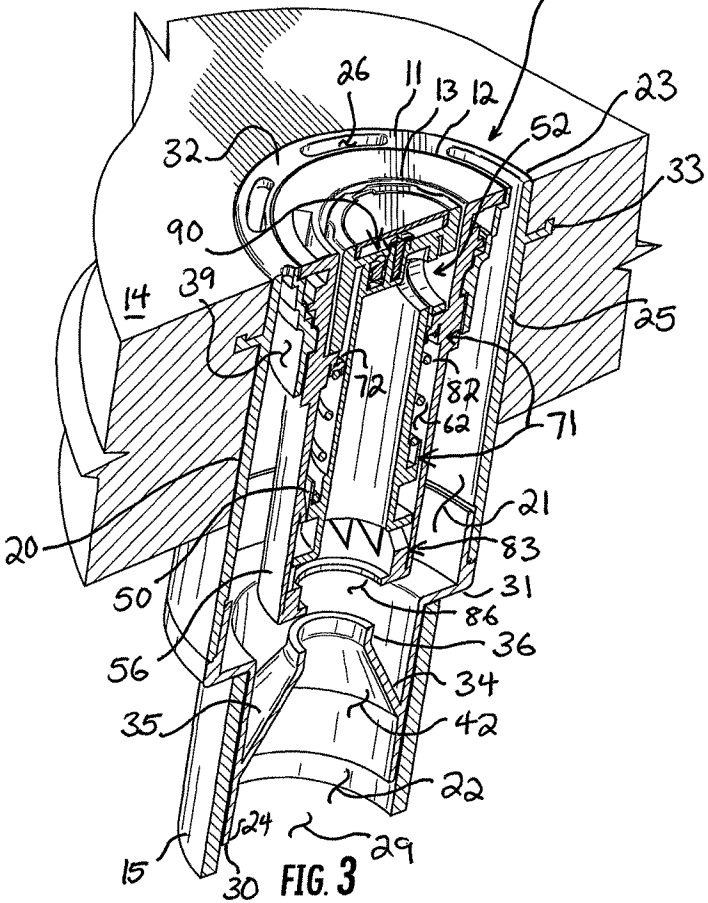

Turning to FIGS. 1 and 2 primarily, the collar 11 of the head 10 is shown. The collar 11 includes a body 20 housing and defining an upper chamber 21 and a lower chamber 22 in fluid communication with each other. The body 20 is shown as a two-piece assembly very roughly corresponding to the upper and lower chambers 22 as a result of manufacturing techniques, and it should be understood that in other embodiments, the body 20 is a single monolithic piece, or that it may be constructed from several pieces without corresponding affect to the upper and lower chambers 21 and 22. The collar 11 generally has rotational symmetry about a vertical axis Z. The upper and lower chambers 21 and 22 are coaxial and generally cylindrical in the embodiment shown, extending along the axis Z. The collar 11 has an open top 23, located in a downstream position, and an opposed open bottom 24, located in an upstream position. The lower chamber 22 is bound by the bottom 24 and extends upward to the upper chamber 21. The upper chamber 21 extends from the lower chamber 22 upward to terminate at the top 23. In a preferred installation, as shown in FIGS. 3 and 4, the top 23 is flush with the pool surface 14.

The body 20 of the collar 11 is preferably formed by a sidewall 25. The sidewall 25 is cylindrical, and at the lower chamber 22 has a first diameter. The collar 11 widens from the lower chamber 22 to the upper chamber 21: proximate to the upper chamber 21, the sidewall 25 has a second diameter which is larger than the first diameter proximate to the lower chamber 22. The sidewall 25 defines these first and second diameters. The sidewall 25 extends continuously around the upper and lower chambers 21 and 22 and from the bottom 24 to the top 23. The first diameter proximate to the lower chamber 22 is defined by the piping assembly 15.

The sidewall 25 terminates in a rim 30 at the bottom 24 of the collar. The rim 30 bounds and defines a circular lower inlet 29. From the rim 30, the sidewall 25 extends upward parallel to the axis Z to a shoulder 31, where the sidewall 25 turns normal to the axis Z and expands radially outward from the axis Z from the first diameter to the second diameter. The sidewall 25 then turns back and extends upward parallel to the axis Z from the shoulder 31 to the top 23 of the collar 11. At the top 23, the sidewall 25 turns inwardly toward the axis Z to define a lip 32. The lip 32 is a flat annulus formed with a plurality of apertures 26 which define an upper inlet into the upper chamber 21. The lip 32 bounds and defines an opening 38 at the top 23, which leads to the upper and lower chambers 21 and 22. The sidewall 25 then progresses in a stepwise fashion both radially inwardly and downwardly along the axis Z, progressively decreasing in diameter so as to form a series of integral concentric shoulders which cooperate to define a seat 37, into which the insert 12 is seated, applied, and securely held. The seat 37 is annularly set apart and spaced from the sidewall 25, thereby defining an annular intake chamber 39 between the seat 37 and the sidewall 25. The annular intake chamber 39 is coupled in fluid communication to the pool through apertures 26 and is also coupled in direct fluid communication to the upper chamber 21. The seat 37 is formed integrally and monolithically to the sidewall 25 of the body 20, meaning that the sidewall 25, the lip 32, and the seat 37 are all formed from one piece of material.

The sidewall 25 further includes a truncated, open-ended cone 34 in the lower chamber 22. The cone 34 is formed integrally to the sidewall 25 and extends radially inwardly and upwardly along the axis Z. The cone 34 is thus directed upward, meaning that its wider opening is upstream from and below its narrower opening. The cone 34 includes an apron 35 which converges toward the axis Z at an angle of approximately 45 degrees, and terminates in a short, upwardly-directed collar 36. The collar 36 is disposed just below the shoulder 31. The apron 35 of the cone 34 has a height A along the axis Z, and the collar 36 of the cone 34 has a height B along the axis Z which is approximately one-fourth the height A of the apron 35. The height A of the apron 35 is approximately one-third the first diameter of the lower chamber 22. In other embodiments, the dimensions of the cone 34 are different, and the above description of the proportions are not to be construed as limiting. The cone 34 has an upstream entrance 42 which has a circular area; the area of the entrance 42 of the cone 34 is greater than the collective areas of the apertures 26.

The sidewall 25 further includes a flange 33 extending radially outwardly from the sidewall 25 just below the top 23 of the collar 11. The flange 33 is formed integrally to the sidewall 25, and aids in securing the collar 11 during and after installation.

The collar 11 is fixed in place during pool construction. Referring to FIGS. 3 and 4, the head 10 is shown installed in a pool wall 40 with the pool surface 14. But for the top 23 of the collar 11, the collar 11 is encased in the pool wall 40: the pool wall 40 surrounds head 10. The top 23 of the collar 11 is flush with the pool surface 14 of the pool wall and is exposed. The insert 12 and the piston 13 are similarly exposed. The flange 33 is encased in the pool wall 40 and prevents vertical movement of the head 10 in the pool wall 40. Though not shown, the head 10 is plumbed conventionally to the piping assembly 15 which is coupled to the pump and filtration system. The lower chamber 22 thus has the first diameter, referred to now as diameter D1, which corresponds to the piping assembly 15. The second diameter of the upper chamber 21 is referred to as diameter D2, and, as previously explained, is larger than the diameter D1. The collar 36 of the cone 34 has a diameter D3, which is smaller than both the diameters D2 and D1.

Referring again to FIG. 2, the apertures 26 and the cone 34 cooperate to form elements of a Venturi assembly, defined herein as an assembly which causes a Venturi effect, namely, which increases the flow of fluid through a structure and which exploits a pressure differential to draw fluid from a fluid source which is separate from another source of flow of fluid and which is external to the assembly. Fluid (preferably water) is applied to the head 10 along line W as shown in FIG. 2. Without the cone 34, fluid would pass directly into the lower chamber 22 and then uninterrupted into the upper chamber 21. With the cone 34, fluid passes into the lower chamber 22 and then is constricted by the inwardly-tapering apron 35 before being ejected as a stream along line S in the supper chamber 22. According to the Venturi principle, as a flow of fluid is constricted, the pressure of that flow of fluid decreases. Thus, as the flow of fluid moves along line W from the lower chamber 22 through the apron 35, the fluid pressure of the flow of fluid drops. Conversely, and in accordance with the Bernoulli principle, as the fluid pressure of the flow of the fluid decreases, the speed of the flow increases. Thus, the flow of fluid increases in speed as it passes through the cone 34. Referring briefly to FIGS. 3 and 4, the flow of fluid now moves along line W directly and quickly from the cone 34 to the insert 12 and the piston 13, thereby moving through the piston 13 faster and exiting the piston 13 faster than would occur if the collar 11 were not fitted with the cone 34.

The application of water along line W through the cone 34 creates a pressure decrease at the collar 36 of the cone 34 as described above. The head 10, submerged in water, is filled with water. The pressure decrease at the collar 36 is relative to the pressure in the lower chamber 22 and in the upper chamber 21. Because the water pressure in the upper chamber 21 is greater than the pressure at the collar 36 while water is being applied through the cone 34, water is drawn from the upper chamber 21 toward the cone 34 and the stream of water along line S. The water being drawn toward the cone 34 and the stream of water along line S is drawn from the upper chamber 21 and from the pool through the apertures 26 in the lip 32. The apertures 26 join the upper chamber 21 in full fluid communication with the water in the pool, so that water may be readily drawn into the upper chamber 21 without restriction (as may otherwise occur in small gaps or cracks in the head 10 arising from manufacturing inconsistencies). The apertures 26 defining the upper inlet are separate from and circumferentially offset from the opening 38 within the seat 37, so that water follows a path outside the seat 37 and around the insert 12 to enter the upper chamber 21 from the pool. Water is drawn along lines I through the apertures 26, down the upper chamber 21, and into the stream S of water below the piston 13. This provides the stream S of water with an increased volume, so that more water can be directed out of the piston and across the pool surface 14.

In FIGS. 1-4, the apertures 26 are shown in a preferred shape which is an oval curved to correspond to an arc about the axis Z. The quasi-oval shape of the apertures 26 allows a large volume of water to flow through the lip 32 into the upper chamber 21 while still maintaining rigidity and strength of the lip 32. In other embodiments, the apertures 26 are circular in shape, closely or widely spaced apart, or may be other various shapes which retain the characteristics of strength of the lip 32, rigidity of the lip 32, and allowing a high volumetric flow through the lip 32.

The insert 12 and the piston 13 contain and direct the stream of water along line S to distribute that stream across the pool surface 14 so as to clean the pool surface 14. The insert 12 and the piston 13 are nearly identical to the insert and piston structures disclosed in U.S. Patent application Ser. No. 14/504,320, filed Oct. 1, 2014, which is hereby incorporated by reference. However, because the head 10 can be removed and replaced with another head, and because the collar 11 is permanently installed in the piping assembly 15, the collar 11 can "boost" the performance of many different heads which are adapted to be received in the collar 11. For this reason, the insert 12 and piston 13 described herein should be considered exemplary.

The piston 13 includes a stem 50, a cap 51, and a nozzle assembly 52 formed between the stem 50 and cap 51 which provides several differently-sized water discharge openings for selection by an operator. An operator can select and set the nozzle assembly 52 to discharge the stream of water through an opening of a particular size, so that the head 10 performs optimally with the characteristics and requirements of the rest of the swimming pool system.

The insert 12 includes a generally cylindrical body having a top, an opposed open bottom, and a continuous sidewall 56 extending between the top and bottom. The sidewall 56 includes an outer surface and an opposed inner surface, which, together with the top of the insert 12, bounds and defines a cylindrical hollow 62 disposed within the insert 12 on the axis Z. The outer surface of the insert 12 is received and seated against the collar 11. In some embodiments, the insert 12 includes tabs which lock into corresponding grooves formed in the collar 11.

In the embodiment shown in FIGS. 3 and 4, a set of elongate teeth defining an engagement element of an upper engagement assembly 71 are formed along the inner surface of the insert 12 in the lower hollow 44 proximate a median radially-extending lip 72. These upper teeth are integrally formed to the inner surface, constituting projections extending radially inwardly slightly from the inner surface and projecting axially downward continuously from the lip 72. There are preferably twelve upper teeth, and the upper teeth are structured and arranged for engaging with a complemental set of preferably twelve lower teeth carried on the piston 13 when the piston 13 is in the raised position thereof. Twelve spaced-apart elongate channels are formed among the upper teeth, each of which is aligned parallel to the axis Z.

The channel, together with the back and face of the upper teeth bordering the channel, cooperate to define guide means which receive and guide the movement of the lower teeth of the upper engagement assembly 71 carried on the piston 13 relative to the upper teeth as the piston 13 reciprocates between the raised and lowered positions thereof. In this way, the guide means guide rotation of the piston 13 during reciprocation of the piston 13 between the raised and lowered positions thereof. The channel is aligned axially with respect to the hollow 62, and the piston 13 reciprocates within the hollow 62, causing the piston 13 to reciprocate axially with the channel and rotate at the entrance and terminus of the channel.

Referring back to FIG. 1, the piston 13 includes the stem 50 and the cap 51. Referring back to FIG. 1, the piston 13 includes a stem 50 and a cap 51. The lower teeth are formed integrally and preferably monolithically to the stem 50 and are directed upward toward the top of the stem 50. Each tooth is separated by a break reduced in diameter from the diameter of the lower teeth, so that the breaks define the lower teeth as separate, discrete protrusions extending radially outward from the piston 13. Each of the breaks has a width between bounding the lower teeth which corresponds to the width of the upper teeth formed on the inner surface of the insert 12, being just greater than the width of the upper teeth so as to allow movement of the lower teeth through the breaks. Likewise, each of the lower teeth has a width which corresponds to the width of the channels formed among the upper teeth in the insert 12, being just less than the width of the channels so as to allow movement of the lower teeth through the channels.

A helical compression spring 82 is carried on the body 72 and compressed in and between two annular channels carried on the insert 12 and the piston 13. The spring 82 biases the piston 13 into the lowered position thereof. The spring 82 is entirely contained with the hollow 62. Each channel is a continuous seat sized to receive the opposed ends of the spring 82.

A lower engagement assembly 83 is formed of a set of upper teeth carried at the bottom of the piston 13 and a complemental set of lower teeth carried at the bottom of the insert 12. The insert 12 has an opening 86 at the bottom to allow water to flow into the insert 12 and into the piston 13. The opening 86 is an inlet to the head 10 to communicate water from the piping assembly 15, through the hollow 62, and through the head 10. The lower teeth extend axially upward away from the bottom of the insert 12. There are preferably twelve lower teeth; the opposing set of upper teeth has preferably six teeth, or half the number of teeth as the set of lower teeth. The upper teeth project downwardly away from the bottom of the piston 13.

The top of the piston 13 is formed with several nozzles formed in the sidewall of the piston 13, each having a different diameter. The cap 51 is fit over the top of the piston 13 to adjustably select one of the nozzles. The cap 51 is configured for rotatable mounting on the stem 50. The cap 51 has a closed top, open bottom, and a generally cylindrical sidewall therebetween which is formed with a single outlet aligned perpendicular to the axis Z. The cap 51 is secured on the stem 50 on a screw or post and a detent assembly 90 is carried between the cap 51 and the top of the stem 50. The detent assembly 90 includes a detent having an enlarged hemispherical head, a slender shank, and a spring encircling the shank and biasing the head upwards. The detent assembly 90 is aligned with cavities in the top of the cap 51, and each cavity is sized and shaped to receive the hemispherical head of the detent when the detent assembly 90 aligns with the cavity and the spring urges the detent upwards into the cavity. In this way, the cap 51 is mounted for rotation among a plurality of positions, each position being indexed by engagement of the detent assembly 90 with one of the cavities and aligning the outlet of the cap 51 with one of the differently-sized nozzles in the stem 80. Preferably, an operator sets the cap 51 to a selected position before the head 10 is installed into the collar 11. Doing so allows the operator to adjust the head 10 more easily than after the head 10 is already installing. The operator adjusts the cap 51 to select one of the differently-sized nozzles based on the design characteristics and requirements of the piping assembly 15, such as pump pressure and flow rate.

Once the operator has properly installed the head 10, it is ready for operation. During operation, water is cyclically applied through the head 10 from the piping assembly 15. When the application of water is provided to the head 10, the piston 13 moves into a raised position, as shown in FIG. 4. When the application of water is removed from the head 10, the piston 13 moves into the lowered position thereof, as shown in FIG. 3, biased into the lowered position by the spring 82. In the embodiment shown in FIGS. 3 and 4, the insert 12 and the piston 13 cooperate to move the piston 13 through one of twelve indexed orientations, wherein each indexed orientation has an angularly offset direction with respect to the other indexed orientations, so that water is directed across the pool surface 14 in twelve angularly offset directions.

When the application of water has been removed from the head 10 or is not being provided to the head 10, no water flows along the line W. The spring 82 biases the piston 13 downward into the lowered position thereof, wherein the top of the piston 13 is flush with the pool surface 14. The piston 13 remains in the downward position thereof while the pump and filtration system of the swimming pool structure, and the piping assembly 15, routes the flow of water to other similar heads around the pool.

When the pump and filtration system routes water back to the head 10, the application of water to the head 10 produces the flow of water through the 10 head along line W, which flow is then constricted at the cone 34. As the flow of fluid is constricted at the cone 34, the speed of the flow of fluid increases, causing the flow to move more rapidly up into the stem 50 of the piston 13. Concurrently, as the flow of fluid is constricted at the cone 34, the fluid pressure of the flow of fluid drops at the collar 36 and in the lower chamber 22 downstream from the cone 34. This decrease in fluid pressure creates a negative pressure with respect to the pool, and water is drawn into the upper chamber 21 through the apertures 26 along lines I in response. The water is drawn down through the annular intake chamber 39, the upper chamber 21, into the lower chamber 22, and into the stream S of water moving from the cone 34 into the piston 13. More water thus moves with the stream S into the piston 13. In this way, more water is directed out across the pool surface 14 through the selected nozzle, so as to clean the pool surface 14 more effectively.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A device for use in a swimming pool structure, the swimming pool structure including a pool and a circulation system having a piping assembly and a pump for cyclically communicating water through the piping assembly, the device comprising:

a collar configured to be coupled directly to the piping assembly, the collar including an upstream bottom and a downstream top;

an insert carried by the collar, and a piston carried by the insert;

the collar includes a lower inlet at the bottom of the collar for fluid communication with the piping assembly, and a truncated open-ended cone carried in the collar downstream from the lower inlet;

the collar includes an opening at the top of the collar which leads to a chamber within the collar, the chamber holding the insert; and the collar includes an upper inlet at the top of the collar for fluid communication with the pool;

wherein the open-ended cone produces a Venturi effect in response to application of water into the collar through the lower inlet, said Venturi effect causing water to move into the collar from the pool through the upper inlet.

2. The device of claim 1, wherein the upper inlet is an assembly of a plurality of apertures.

3. The device of claim 1, wherein the opening at the top of the collar is separate from the upper inlet at the top of the collar.

4. A device for use in a swimming pool structure, the swimming pool structure including a pool and a circulation system having a piping assembly and a pump for cyclically communicating water through the piping assembly, the device comprising:

a collar configured to be coupled directly to the piping assembly, the collar including an upstream bottom and a downstream top;

the collar includes a lower inlet at the bottom of the collar in coupled in fluid communication with the piping assembly; and a truncated open-ended cone carried in the collar downstream from the lower inlet;

wherein the open-ended cone produces a Venturi effect in response to application of water into the collar through the lower inlet, said Venturi effect causing water to move into the collar from the pool through the upper inlet.

5. The device of claim 4, wherein the open-ended cone is directed upward toward the top of the collar.

6. The device of claim 4, wherein the collar further includes an upper inlet at the top of the collar for fluid communication with the pool.

7. The device of claim 6, wherein:

the collar further includes an opening at the top of the collar which leads to a chamber within the collar configured to hold an insert and piston for the device; and the opening at the top of the collar is separate from the upper inlet at the top of the collar.

8. The device of claim 6, wherein the upper inlet is an assembly of a plurality of apertures.

9. A collar for use in a swimming pool structure, the swimming pool structure including a pool and a circulation system having a piping assembly and a pump for cyclically communicating water through the piping assembly, the collar configured to be coupled to the piping assembly; the collar comprising:

a body having an upstream bottom, a downstream top, a sidewall extending therebetween, a hollow within the body configured to hold an insert, and a truncated open-ended cone carried in the body proximate to the bottom of the body;

a seat configured to receive and secure the insert, the seat being set apart annularly from the sidewall so as to define an annular intake chamber therebetween; and the annular intake chamber encircles the seat and is coupled in fluid communication with the pool;

wherein the open-ended cone produces a Venturi effect in response to application of water into the chamber through the open-ended cone, said Venturi effect causing water to move into the collar from the pool through the annular intake chamber.

10. The collar of claim 9, further comprising an upper inlet formed at the top of the collar which couples the annular intake chamber in fluid communication with the pool.

11. The collar of claim 10, wherein:

the seat bounds an opening at the top of the body which leads to the hollow within the collar configured to hold the insert; and the opening at the top of the body is separate from the upper inlet at the top of the collar.

12. The collar of claim 10, wherein the upper inlet is an assembly of a plurality of apertures.

13. The collar of claim 9, wherein the seat is formed monolithically to the sidewall of the body.

14. The collar of claim 9, wherein the open-ended cone is directed upward toward the top of the body.

* * * * *